US005680815A

United States Patent [19]

Laumann et al.

[11] Patent Number: 5,680,815

[45] Date of Patent: Oct. 28, 1997

[54] DAMPENING UNIT FOR AN OFFSET PRINTING MACHINE

[75] Inventors: Harwin Laumann, Dietzenbach; Karl-Peter Klein, Bad Durkheim; Wolfgang Rozek; Peter Hummel, both of Offenbach; Robert Ortner, Alzenau, all of Germany

[73] Assignee: MAN Roland Druckmaschinen AG, Germany

[21] Appl. No.: 608,151

[22] Filed: Feb. 28, 1996

[30] Foreign Application Priority Data

Feb. 28, 1995 [DE] Germany ..... 195 06 923.4

[51] Int. Cl.[6] ..... B41F 7/26; B41F 7/36

[52] U.S. Cl. ..... 101/148

[58] Field of Search ..... 101/147, 148, 101/348, 349–350, 207–210, 351, 352, 363, 364

[56] References Cited

U.S. PATENT DOCUMENTS 3,744,414 7/1973 Krochert et al. ..... 101/148

FOREIGN PATENT DOCUMENTS

| | | |
|---|---|---|
| 1 951 976 | 4/1971 | Germany . |
| 2 007 554 | 8/1971 | Germany . |
| 2 320 430 | 2/1974 | Germany . |
| 30 30 076 C1 | 6/1982 | Germany . |
| 238 574 A1 | 8/1986 | Germany . |
| 484 748 | 3/1970 | Switzerland . |

*Primary Examiner*—J. Reed Fisher

*Attorney, Agent, or Firm*—Leydig, Voit & Mayer, Ltd.

[57] ABSTRACT

A dampening unit for an offset printing machine having an applicator roller including a central section and two oppositely disposed tapered end sections to prevent the transference of excessive amounts of dampening medium to the printing plate is disclosed. The boundaries between each of the end sections and the central section of the applicator roller are located adjacent predetermined regions defined on the plate cylinder to ensure a uniform dampening medium film is produced across the entire format width of the material to be printed.

16 Claims, 2 Drawing Sheets

DAMPENING UNIT FOR AN OFFSET PRINTING MACHINE

FIELD OF THE INVENTION

This invention relates generally to printing machines, and more specifically to an improved dampening unit for an offset printing machine.

BACKGROUND OF THE INVENTION

German Auslegeschrift 2,007,554 discloses a dampening unit which attempts to achieve better dampening of the edge zones of a printing plate serviced by the disclosed unit and to avoid undue streaking. To this end, the disclosed dampening unit includes a dampening roller constructed as a dampening friction roller. The outer surface of the dampening friction roller has a roughness which is greatest at the edge regions of the roller and which decreases towards the central region of the roller.

The dampening unit disclosed in German Auslegeschrift 2,007,554 has certain disadvantages. For example, when the dampening rollers of the disclosed dampening unit and the inking rollers of a serviced printing machine are coupled (in the case of integrated dampening, this coupling is affected by a bridge roller), too much dampening medium may enter the inking unit. Such an introduction of excessive amounts of dampening medium into the inking unit can lead to disturbances in the ink/dampening-medium equilibrium, since the printing ink can absorb too much dampening medium. If this equilibrium is disturbed, an emulsion having an adverse influence on the print quality can be formed.

German Offenlegungsschrift 2,320,430 discloses another dampening unit. In the dampening unit disclosed in this reference, the metering roller which acts as a dampening duct roller (dipping roller) is longer than the adjacent transfer roller, which is, in turn, preferably longer than the dampening applicator roller (form roller) adjacent to the plate cylinder. This arrangement of rollers having staggered axial lengths is intended to minimize or avoid the accumulation of dampening medium at the ends of the rollers and to prevent disturbances of the ink/dampening-medium equilibrium from occurring.

DE 3,030,076 C1 discloses a dampening unit in which the metering roller and the dampening duct roller are longer than the dampening applicator rollers. In order to reduce the pressure force between the two adjacent dampening rollers included in this dampening unit and to prevent an undesirable amount of dampening media from accumulating on the end faces of the rollers, one of the dampening rollers is provided with an elastomeric layer, and the diameter of one of the dampening rollers narrows at its edge regions. However, this dampening unit is only suitable for use with elastomeric rollers.

None of the above-mentioned dampening units, discuss guiding the dampening medium on the printing plate. Moreover, in conventional dampening units, relatively long rollers are required to produce an approximately uniform dampening-medium film across the entire format width of the material to be printed.

OBJECTS OF THE INVENTION

It is a general object of the invention to provide an improved dampening unit for use with an offset printing machine. It is a more specific object of the invention to provide an improved dampening unit which does not introduce excessive amounts of dampening medium into the inking unit. It is a related object to provide such a dampening unit which does not disturb the ink/dampening medium equilibrium. It is a further related object to provide such a dampening unit which does not result in the formation of an emulsion or otherwise adversely effect the print quality of the serviced printing machine.

It is another object of the invention to provide an improved dampening unit which incorporates the guidance of the dampening medium on the printing plate into the design of the dampening-unit rollers. It is still another object to provide a dampening unit which avoids streaking and the other adverse printing effects associated with the accumulation of excess dampening medium at the ends of the dampening rollers which often occurs in prior art dampening units. It is yet another object of the invention to provide a dampening unit which can produce a uniform dampening medium film using shorter rollers than a conventional dampening unit over the same printing format width.

SUMMARY OF THE INVENTION

The present invention accomplishes these objectives and overcomes the drawbacks of the prior art by providing a dampening unit for an offset printing machine having a plate cylinder carrying a printing plate for printing a material. The dampening unit includes a dampening medium container for storing a supply of dampening medium; a duct roller rotatably mounted to transfer the dampening medium out of the dampening medium container; and, an applicator roller operatively engaging the duct roller and the plate cylinder for transferring the dampening medium from the duct roller to the plate cylinder. The applicator roller includes: (1) a central section having a substantially uniform diameter, (2) a first end section disposed at a first end of the central section, and (3) a second end section disposed at a second end of the central section. The first end of the central section is disposed adjacent a first region defined by a first edge of the printing plate and a first edge of the material to be printed, and the second end of the central section is disposed adjacent a second region defined by a second edge of the printing plate and a second edge of the material to be printed. The first and second end sections of the applicator roller are tapered at downwardly inclined opposite angles from the first and second ends of the central section, respectively, such that a substantially uniform film of dampening medium is applied to the printing plate across the format width of the material to be printed.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
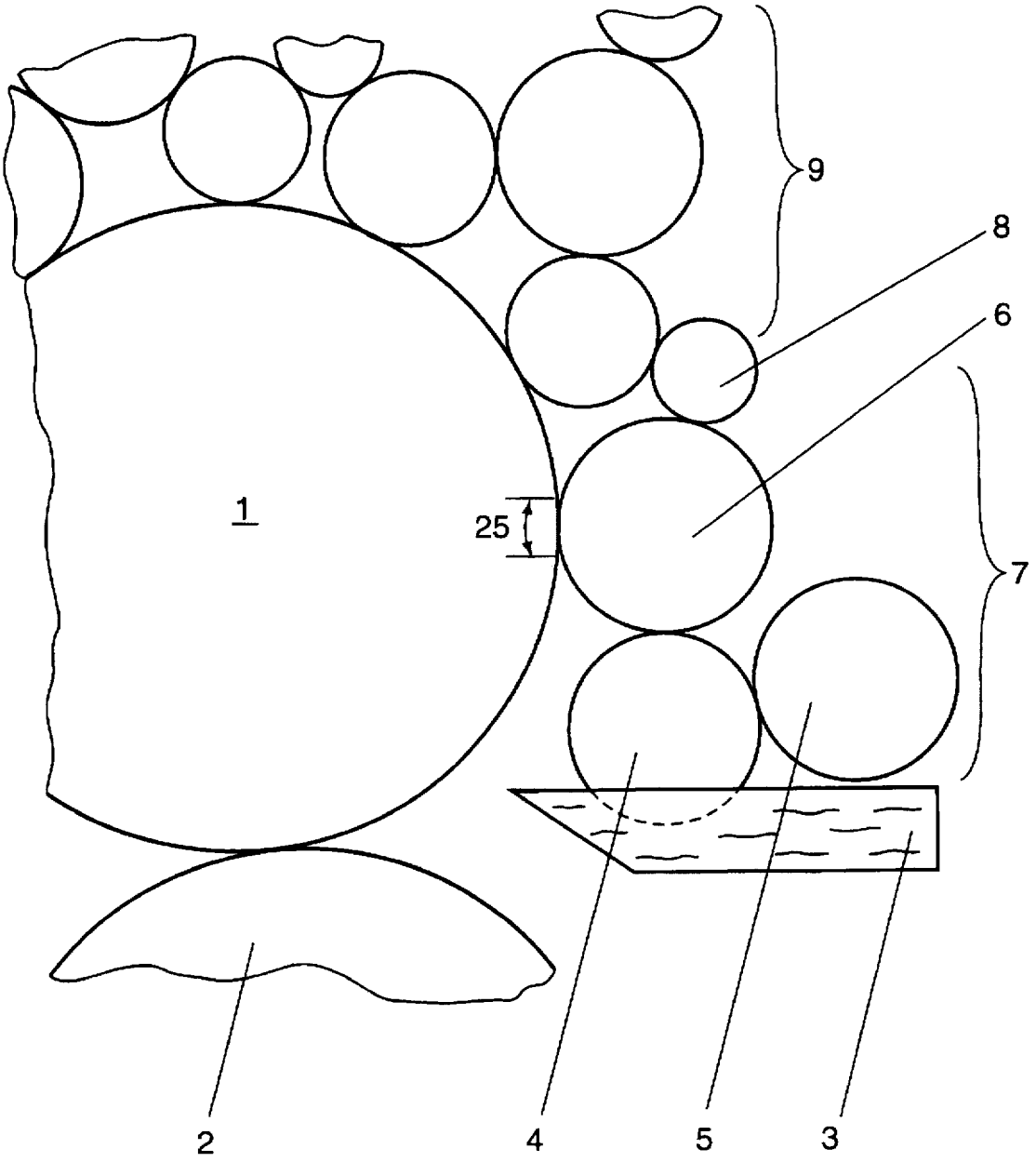
FIG. 1 diagrammatically illustrates a dampening unit mounted within a typical printing unit of a representative offset printing machine; and, FIG. 2 illustrates the roller arrangement of a dampening unit constructed in accordance with the teachings of the invention.

Each printing unit of a typical offset printing machine includes a plate cylinder 1 carrying a printing plate and a rubber-blanket cylinder 2 as shown in FIG. 1. Usually, the printing unit is further provided with a dampening-unit roller train 7 and an inking-unit roller train 9; both of which are assigned to the plate cylinder 1. A switchable bridge roller S is typically provided for selectively engaging the dampening-unit roller train 7 and the inking-unit roller train 9.

Figure 2:
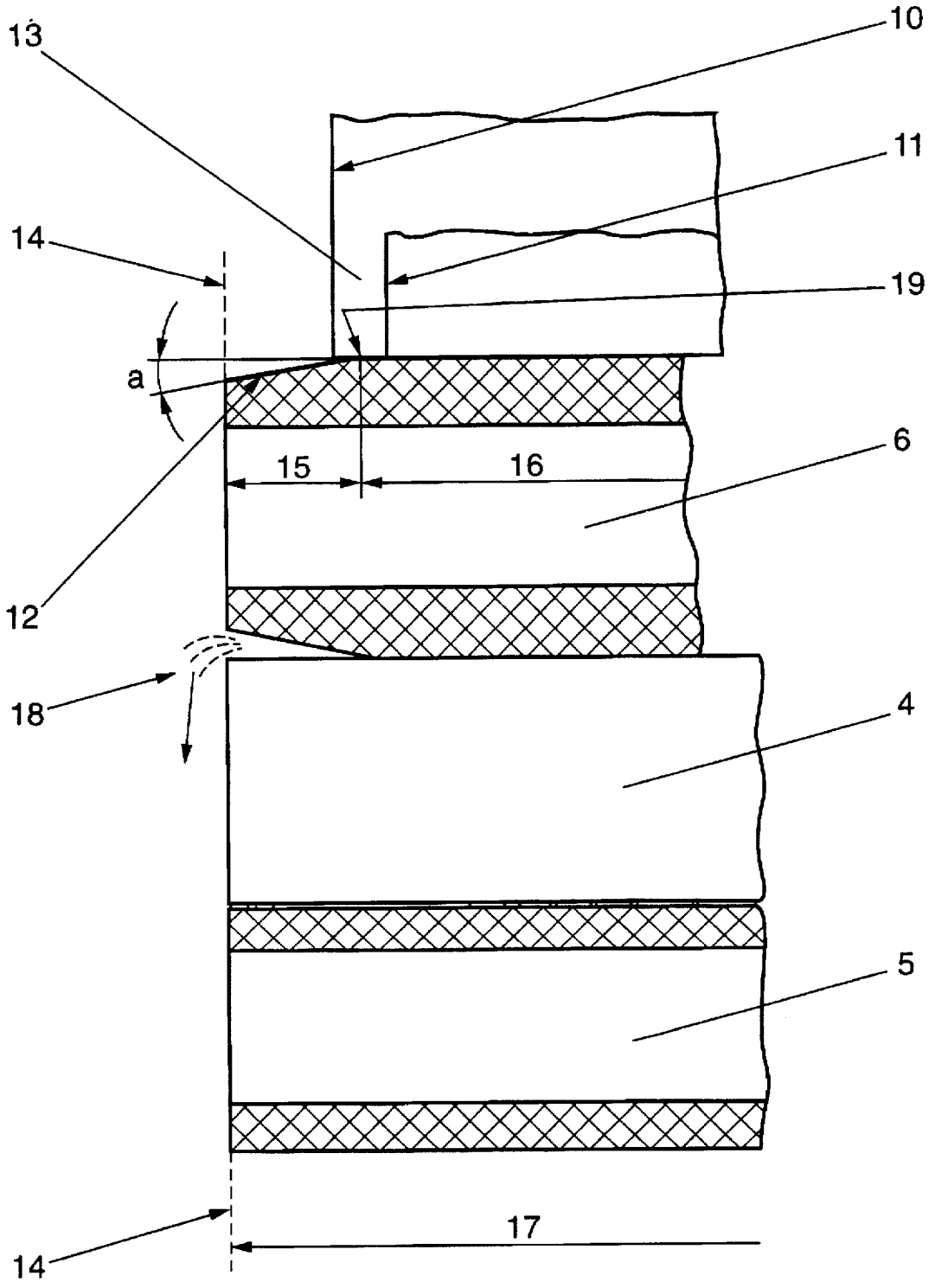

Both the printing plate carried by the plate cylinder and the material to be printed have a width defined by two oppositely disposed edges 10, 11, respectively (FIG. 2). The width of the sheet to be printed (hereinafter the "format width") is smaller than the width of the printing plate. Therefore, a region 13 in which the printing plate extends beyond the material to be printed is defined at either side of the plate cylinder 1. The regions 13 are each defined as the area between the edge 10 of the printing plate and the nearest edge 11 of the material to be printed (FIG. 2).

In order to supply the printing plate carried by the plate cylinder I with dampening medium, the dampening-unit roller train 7 includes a dampening-medium container 3 for storing a supply of a dampening medium such as water; a dampening duct roller 4 dipping into the dampening-medium container 3 for scooping dampening medium therefrom; a metering roller 5 adjacent to the dampening duct roller 4 for limiting the amount of dampening medium transferred out of the container 3 by the dampening duct roller; and, a dampening applicator roller 6 for transferring the dampening medium from the dampening duct roller to the printing plate. The dampening applicator roller 6 is usually fitted with a rubber sleeve (not shown) to facilitate the transference of dampening medium from the dampening duct roller 4 to the plate cylinder 1. The manner of assigning the dampening applicator roller 6 to the plate cylinder 1 is well known in the art and, in the interest of brevity, will not be further explained here.

However, it should be noted that the area of contact 25 between the plate cylinder 1 and the applicator roller 6, commonly referred to as a roller strip, is dependent upon the length of the contacting rollers 1, 6 and the amount of pressure applied to force the contacting rollers together. Specifically, large rollers are somewhat flexible and will bow in different amounts under varying loads. Therefore, although the lengths of the rollers are fixed, the width of the roller strip 25 can be modified by adjusting the amount of pressure used to force the rollers together. In the illustrated embodiment, the roller strip 25 is approximately 7 millimeters wide.

In accordance with an important aspect of the invention, the dampening applicator roller of the inventive dampening apparatus is constructed to include a central region having a substantially uniform diameter and two, oppositely disposed, tapered end regions to both provide a uniform film of dampening medium on the printing plate carried by the plate cylinder, and to avoid the adverse printing effects associated with prior art dampening units. In the illustrated embodiment, this aspect of the invention is implemented by a dampening applicator roller 6 having a total roller length 17 which is divided into three integral sections, namely, a central section 16 having a uniform diameter and two, oppositely disposed, end sections 15.

In order to prevent an excessive amount of dampening medium from collecting at the edges of the applicator roller 6, the end sections 15 are tapered. In other words, the diameter of each of the end sections decreases from a maximum length at the boundary 19 between each end section 15 and the ends of the central section 16, to a minimum length at the opposite end faces of the applicator roller 6. To this end, the diameter reductions 12 of the end sections 15 are each formed by a bevel which descends at an acute angle $\alpha$ from a respective boundary 19 towards an end face of the dampening applicator roller 6. (FIG. 2) Depending on the existing Shore hardness of the dampening applicator roller 6, an acute angle $\alpha$ of 1° to 15° is preferred. More specifically, for a relatively large Shore hardness, an angle $\alpha$ of 1° to 7° is preferred, whereas for a relatively small Shore hardness, an angle $\alpha$ of 7° to 15° is preferred. Furthermore, depending on the existing Shore hardness of the dampening applicator roller 6, the individual lengths of the end sections 15 are preferably in excess of 20 mm. Those skilled in the art will appreciate that lengths in excess of 20 mm are preferred because, if the lengths of the end sections 15 are shortened while keeping the angle $\alpha$ fixed, the separation between the end sections 15 and the plate cylinder 1 will be geometrically reduced.

Although, in the illustrated embodiment, the end sections 15 are substantially symmetrical (i.e., tapered in equal but opposite directions and having the same overall length), those skilled in the art will appreciate that non-symmetrical end sections could also be employed without departing from the scope or the spirit of the invention. Similarly, although the ranges of angles and lengths set forth above are preferred, other lengths and angles could likewise be employed without departing from the scope or the spirit of the invention.

In accordance with a further aspect of the invention, the boundaries formed between each of the end sections and the ends of the central section of the applicator roller (i.e., the points at which the end regions begin to taper), are located adjacent to predetermined regions defined on the plate cylinder 1 to ensure that a uniform layer of dampening material is applied across the entire format width of the material to be printed. The predetermined regions are the above-mentioned regions 13 defined at either end of the plate cylinder 1 by the adjacent ends 10, 11 of the printing plate and the sheet to be printed, respectively. As a result, the sheet to be printed will only contact the film of dampening medium applied to the printing plate by the uniform diametered, central section 16 of the applicator roller 6 thereby ensuring that a uniform coating of dampening medium is applied across the format width of the material to be printed. More specifically, since the tapered end sections 15 of the applicator roller 6 do not contact the edges of the downstream rollers, the applicator roller 6 will not transfer the excessive amounts of dampening medium typically present on the edges of the downstream rollers to the edges of the printing plate, and the dampening medium film on the printing plate will, therefore, remain uniform across the entire format width of the material to be printed.

In the preferred embodiment, the applicator roller 6 is constructed such that the opposite ends of the central section 16, (i.e., the boundaries 19 between the end sections 15 and the central section 16), are centrally located with respect to the regions 13. For example, if the regions 13 each have a width of 5 mm, then the boundaries 19 are preferably located adjacent their respective region 13 at a point 2.5 mm from both the edge 10 of the printing plate and the edge 11 of the material to be printed. However, those skilled in the art will readily appreciate that the boundaries 19 can be located anywhere adjacent to their respective region 13 without departing from the scope or the spirit of the invention.

To ensure the advantages associated with the tapered-end construction of the applicator roller 6 discussed above are realized, the rollers of the dampening unit are preferably positioned in roller alignment or, alternatively, the applicator roller 6 is constructed to have a shorter length than the other rollers of the dampening unit. If the first alternative (shown in FIG. 2) is employed, the dampening applicator roller 6, the dampening duct roller 4 and the metering roller 5, preferably have a uniform roller length 17. Those skilled in the art will appreciate that employing an applicator roller which is longer than the other rollers of the dampening unit will either diminish or eliminate the advantages gained by the inventive dampening unit since, depending upon the relative lengths of the rollers employed, the central section 16 of the applicator roller can come into contact with the edge regions of the downstream rollers and the excessive amounts of dampening medium which these edge regions tend to carry. Thus, although applicator rollers that are longer than their downstream rollers could be employed, they are not preferred.

In operation, the dampening duct roller 4 of the inventive dampening unit conveys the liquid dampening medium out of the dampening-medium container 3. In order to control the amount of dampening medium conveyed, the metering roller 5 splits the dampening-medium film on the dampening duct roller 4. The dampening medium which remains on the duct roller 4 is transported to the dampening applicator roller 6 which, in turn, applies the dampening-medium film onto the printing plate. A first amount of dampening medium is guided into the central section 16 of the applicator roller 6, and a second amount of dampening medium, which is less than the first amount, is guided into the end sections 15 of the dampening applicator roller 6. Since, in the illustrated embodiment, the rollers of the dampening unit are positioned in roller alignment 14, an excessive amount of dampening medium cannot be conveyed onto the printing plate via the end faces of the dampening-unit roller train 7. On the contrary, the arrangement of rollers employed in the illustrated embodiment permits a return 18 of dampening medium via the end faces of the dampening duct roller 4 in the direction of the dampening-medium container 3.

In summary, those skilled in the art will appreciate that the disclosed dampening unit produces a highly uniform dampening medium film on the plate cylinder which is stable even in the lateral regions of the printing plate. Thus, the dampening medium film is stable over the entire format width of the material to be printed. As a result, the maximum format width of the printing material can be utilized as the maximum printing area. That is to say, the printing material can be printed over its entire format width, without producing a lateral white edge visible to the naked eye.

It will be further appreciated that another advantage of the inventive printing unit is that a possible splashing of dampening medium or washing medium (in the operating position "wash rollers") and the emulsification of dampening medium and ink are both prevented.

In addition, those skilled in the art will appreciate that conventional dampening units sometimes suffered from adverse printing effects caused by an uneven shifting of the rubber sleeve adjacent the ends of the applicator roller associated with the sleeve. The present invention avoids such adverse printing effects since, if such shifting of the rubber sleeve occurs, it will occur adjacent the end sections 15 of the applicator roller 6 where the rubber sleeve is not in contact with the printing plate. In other words, the dampening unit of the present invention produces a parallel roller strip 25 across the entire format width of the material to be printed even if undesirable shifting of the rubber sleeve is present.

Finally, although the illustrated embodiment includes a single dampening applicator roller 6, those skilled in the art will readily appreciate that a plurality of dampening applicator rollers assigned to the plate cylinder and/or dampening-roller trains with different roller arrangements could be employed without departing from the scope or the spirit of the invention.

Although the invention has been described in connection with certain embodiments, it will be understood that there is no intent to in any way limit the invention to those embodiments. On the contrary, the intent is to cover all alternatives, modifications and equivalents included within the spirit and scope of the invention as defined by the appended claims.

We claim:

1. A dampening unit for an offset printing machine, the printing machine having a plate cylinder carrying a printing plate for printing a material, the printing plate having a first width defined by first and second edges disposed at opposite sides of the printing plate, and the material to be printed having a format width defined by first and second edges disposed at opposite sides of the material to be printed, the format width being smaller than the first width, the dampening unit comprising:

a dampening medium container for storing a supply of dampening medium;

a duct roller rotatably mounted to transfer the dampening medium out of the dampening medium container; and, an applicator roller operatively engaging the duct roller and the plate cylinder for transferring the dampening medium from the duct roller to the plate cylinder; the applicator roller including: (1) a central section having a substantially uniform diameter, (2) a first end section disposed at a first end of the central section, and (3) a second end section disposed at a second end of the central section; the first end of the central section being axially located next to a first axial region of the plate cylinder defined between the first edge of the printing plate and the first edge of the material to be printed, and the second end of the central section being axially located next to a second axial region defined between the second edge of the printing plate and the second edge of the material to be printed; the first and second end sections of the applicator roller being tapered at downwardly inclined opposite angles from the first and second ends of the central section, respectively, such that a substantially uniform film of the dampening medium is applied to the printing plate across the format width of the material to be printed.

2. A dampening unit as defined in claim 1 wherein the first end of the central section of the applicator roller is centrally disposed with respect to the first region.

3. A dampening unit as defined in claim 2 wherein the second end of the central section of the applicator roller is centrally disposed with respect to the second region.

4. A dampening unit as defined in claim 1 wherein the angles of the first and second end sections are equal but opposite in direction.

5. A dampening unit as defined in claim 4 wherein the equal but opposite angles fall between 1° and 15° inclusive.

6. A dampening unit as defined in claim 1 wherein the duct roller and the applicator roller are disposed in roller alignment.

7. A dampening unit as defined in claim 1 wherein the applicator roller is shorter in length than the duct roller.

8. A dampening unit as defined in claim 1 further comprising a metering roller in operative engagement with the duct roller for limiting the amount of dampening medium transferred from the dampening medium container to the applicator roller by the duct roller.

9. A dampening unit for an offset printing machine, the printing machine having a plate cylinder carrying a printing plate for printing a material, the material to be printed having a format width, the dampening unit comprising:

a dampening medium container for storing a supply of dampening medium;

a duct roller rotatably mounted to transfer the dampening medium out of the dampening medium container; and, an applicator roller operatively engaging the duct roller and the plate cylinder; said applicator roller having an outer surface for receiving dampening medium from said duct roller; the applicator roller dampening medium receiving surface being defined by: (1) a central cylindrical section of substantially uniform diameter, (2) a first end section disposed at a first end of the central section, and (3) a second end section disposed at a second end of the central section; the first and second end sections of the applicator roller being tapered at downwardly inclined opposite angles from the first and second ends of the central section, respectively, such that a substantially uniform film of the dampening medium is applied to the printing plate across the format width of the material to be printed;

wherein said tapered end sections are tapered at an angle of between 1 and 15 degrees inclusive.

10. A dampening unit as defined in claim 9 wherein the angles of the first and second end sections are equal but opposite in direction.

11. A dampening unit as defined in claim 9 wherein the duct roller and the applicator roller are disposed in roller alignment.

12. A dampening unit as defined in claim 9 wherein the applicator roller is shorter in length than the duct roller.

13. A dampening unit as defined in claim 9 further comprising a metering roller in operative engagement with the duct roller for limiting the amount of dampening medium transferred from the dampening medium container to the applicator roller by the duct roller.

14. A dampening unit as defined in claim 9 in which said applicator roller dampening medium receiving surface is defined by a non-metallic material.

15. A dampening unit as defined in claim 9 in which said end sections of said applicator roller each have an axial length of at least 20 mm.

16. A dampening unit for an offset printing machine, the printing machine having a plate cylinder carrying a printing plate for printing a material, the material to be printed having a format width, the dampening unit comprising:

a dampening medium container for storing a supply of dampening medium;

a duct roller rotatably mounted to transfer the dampening medium out of the dampening medium container; and, an applicator roller operatively engaging the duct roller and the plate cylinder for transferring the dampening medium from the duct roller to the plate cylinder; the applicator roller including: (1) a central section having a substantially uniform diameter, (2) a first end section disposed at a first end of the central section, and (3) a second end section disposed at a second end of the central section; the first and second end sections of the applicator roller being tapered at downwardly inclined opposite angles from the first and second ends of the central section, respectively; and one end of said central section being axially located next to a first axial region of the plate cylinder defined between an edge of the printing plate and an edge of the material to be printed adjacent one axial end of the plate cylinder and an opposite end of the central section being axially located next to an axial region of the plate cylinder between an edge of the printing plate and an edge of the material to be printed adjacent an opposite axial end of the plate cylinder, such that a substantially uniform film of the dampening medium is applied to the printing plate across the format width of the material to be printed.

* * * * *